US005633044A

United States Patent [19]

Linnonmaa

[11] Patent Number: 5,633,044

[45] Date of Patent: May 27, 1997

[54] METHOD AND APPARATUS FOR SPRAY-COATING A PAPER OR BOARD WEB

[75] Inventor: Pekka Linnonmaa, Helsinki, Finland

[73] Assignee: Valmet Corporation, Helsinki, Finland

[21] Appl. No.: 494,376

[22] Filed: Jun. 26, 1995

[30] Foreign Application Priority Data

Jul. 1, 1994 [FI] Finland ..... 943191

[51] Int. Cl.[6] ..... B05D 7/00

[52] U.S. Cl. ..... 427/421; 427/345; 427/424; 118/324; 118/325; 118/326

[58] Field of Search ..... 427/421, 424, 427/345; 118/324, 325, 326

[56] References Cited

U.S. PATENT DOCUMENTS 4,257,344 3/1981 Coq ..... 118/325
4,448,818 5/1984 Hartog et al. ..... 118/326
4,520,755 6/1985 Inukai et al. ..... 118/325
4,944,960 7/1990 Sundholm et al. ..... 118/325

*Primary Examiner*—Benjamin Utech
*Assistant Examiner*—David M. Maiorana
*Attorney, Agent, or Firm*—Cohen, Pontani, Lieberman, Pavane

[57] ABSTRACT

A method and apparatus for spray coating a paper or board web in which a coating paste or mix is applied as an aerosol to the web in an enclosed space or chamber. A flow of the coating paste flows down at least one of the interior walls of the enclosed space, thereby collecting excess coating paste aerosol and providing a seal between the web and the walls of the enclosed space. By providing this seal, the amount of excess coating paste aerosol escaping from the enclosed space and the amount of air travelling along the surface of the web are both reduced, thereby increasing the quality of the applied coating.

12 Claims, 5 Drawing Sheets

METHOD AND APPARATUS FOR SPRAY-COATING A PAPER OR BOARD WEB

FIELD OF THE INVENTION

The present invention relates to a method and apparatus for spray-coating a paper or board web.

BACKGROUND OF THE INVENTION

Conventionally, coating paste or mix is applied to a paper or board web using so-called spray coaters in which a coating paste is sprayed on a paper or board web from a distance. The quality of the coating is controlled by adjusting the distance between the spraying nozzle and the web, the spraying jet velocity and the mass rate of spraying. Furthermore, the coat quality can be modified by adjusting the coating paste formulation and proportion of its components. In nozzles utilizing compressed air for atomizing the coating paste, the air pressure supplied to the nozzle provides an additional control variable. The spraying apparatus is typically enclosed in a tray hood which surrounds the nozzle assembly and extends over the entire cross-machine width of the web. The bottom of the tray is provided with a duct for removing excess coating paste. Because the coating paste being sprayed is an aerosol, it expands to fill the entire volume of the tray hood. However, the aerosol also forms larger droplets which may impair the coating quality if these larger droplets contact the web. Further, as the gaps between the coater and the web are awkward or difficult to seal, the coating paste aerosol typically escapes to the surroundings of the coater hood and may impair the quality of the coating applied to the web and may also soil equipment in addition to the coater. Removal of such excess aerosol by means of suction is difficult since separation of the paste droplets from the air flow prior to the coating paste recirculation requires use of expensive and complex filtering devices.

U.S. Pat. No. 4,944,960 describes a spray coater utilizing the above-described suction methods for reducing the dessemination of the excess coating aerosol.

SUMMARY OF THE INVENTION

It is an object of the present invention to overcome the drawbacks of the above-described prior-art techniques and to achieve an entirely novel spray-coating method and spray coater.

The goal of the present invention is accomplished by having coating paste or mix flow along at least one of the inner walls of the tray hood enclosing the spraying nozzles, whereby the flow absorbs excess coating paste aerosol.

The invention offers significant benefits.

The spray coater according to the present invention is capable of essentially reducing the amount of excess coating paste aerosol because the coating paste flow effectively absorbs such excess aerosol. No filtering devices are required and the aerosol is prevented from agglomerating into larger droplets which might impair the coating quality. The present invention is capable of improving the efficiency of a spray-coater apparatus by collecting the excess coating paste aerosol for recirculation of the coating paste back to the spraying nozzle. Because the coating paste flowing along the inner walls of the tray hood provides an effective barrier proximate the surface of the web being coated, there is a significant reduction in the amount of air travelling along with the moving web that tends to disturb the coating process. Consequently, the quality of the resulting coating is improved. Additionally, the paste flow acts as a seal of the coating chamber thereby reducing the amount of coating paste aerosol that escapes from the coating chamber.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
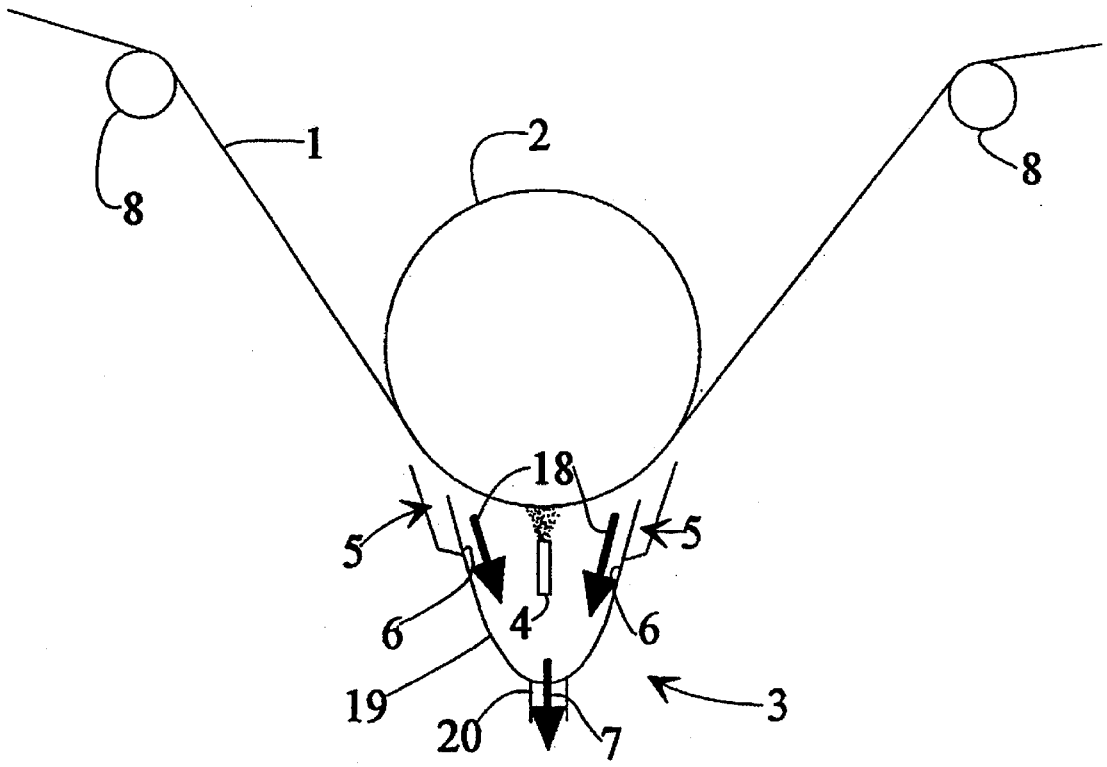
FIG. 1 is a schematic side view of a first embodiment of the spray-coating apparatus according to the present invention.

Referring to FIG. 1, a web 1, supported by guide rolls 8 is wrapped onto the surface of a backing roll 2. A spray coater 3 is positioned under the backing roll 2 so that its spraying nozzles 4 discharge an aerosol of the coating paste or mix onto the surface of the paper web 1. Alternatively, as discussed below with reference to FIG. 5, the web 1 may be supported by a belt or wire instead of a backing roll. The spraying nozzles 4 are arrayed to extend over the entire cross-machine width of the web 1. The nozzles 4 are enclosed by a tray hood or chamber 19, whose outer edges that are provided with overflow trays 5 into which sufficient coating paste is fed so that coating paste flows 18 at a substantially constant rate along the side walls 6 of the tray hood 19 and is then removed via an outlet nozzle 20 (shown as the outlet flow 7) for recycling. The distance between the spray coater 3 and the web 1 is preferably adjustable. By moving the coater 3 as close as possible to the web 1 without contacting it, the air layer travelling along with the web 1 can be reduced. The overflow of the coating paste past the edges of the overflow trays 5 thus acts as an effective air barrier to reduce the air layer travelling with the web 1 and to reduce the escape of aerosol coating paste from the chamber of the spray coater 3. The distance between the spraying nozzles 4 and the web 1 is preferably also separately adjustable, as well as the mass rate of flow of the coating paste to the spraying nozzles 4. Furthermore, the angle of incidence of the aerosol spray to the paper or board web 1 is preferably adjustable within the constraints of the physical dimensions of the tray hood 19. This arrangement allows the coating quality and the aerosol generation inside the tray hood 19 to be controlled.

Figure 2:
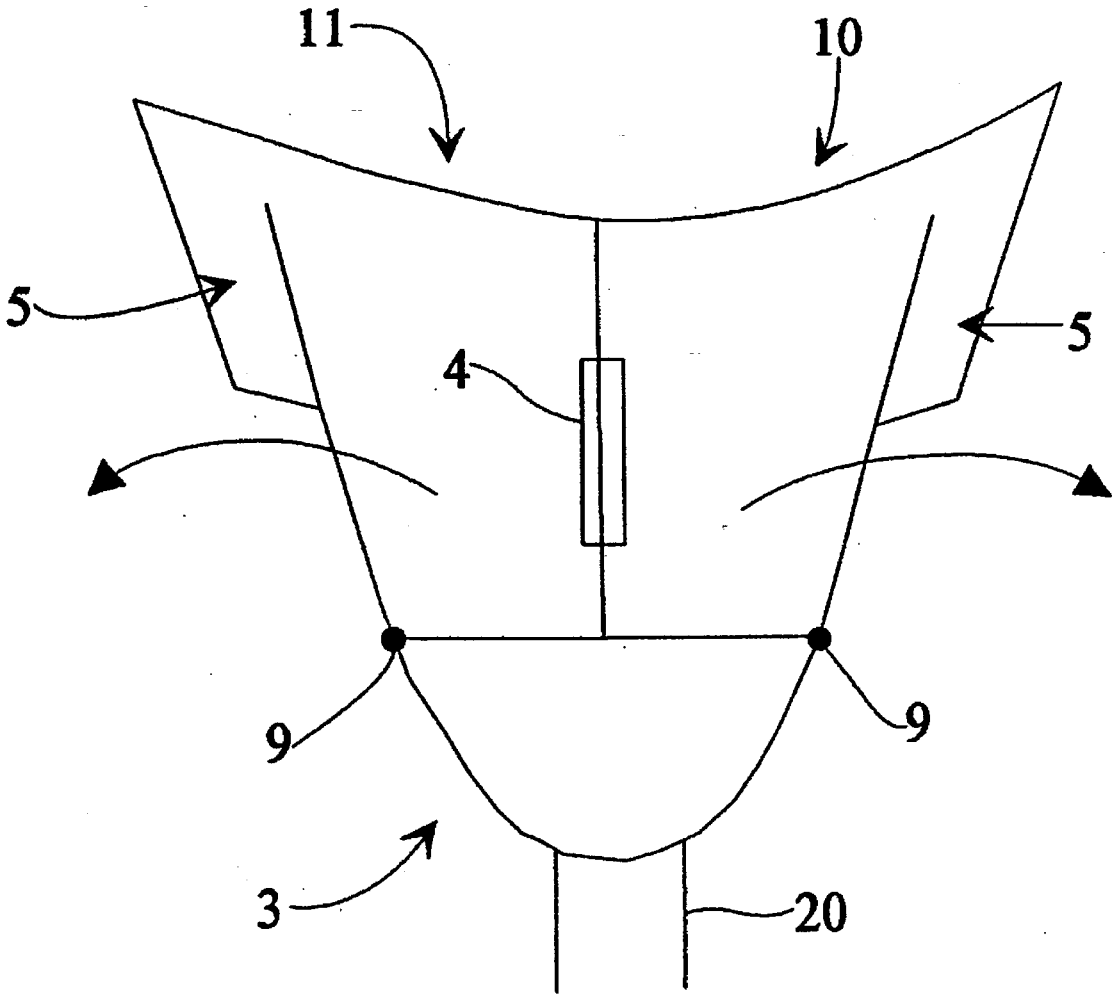
FIG. 2 is a schematic side view of a second embodiment of the spray-coating apparatus according to the present invention.

Referring to FIG. 2, an embodiment of the present invention is shown in which the spray coater 3 is divided into two sections 10 and 11 which are hingedly connected to each other by joints 9 about which the apparatus can be opened for cleaning as indicated by the arrows. This arrangement provides easy cleaning of the apparatus.

Figure 3:
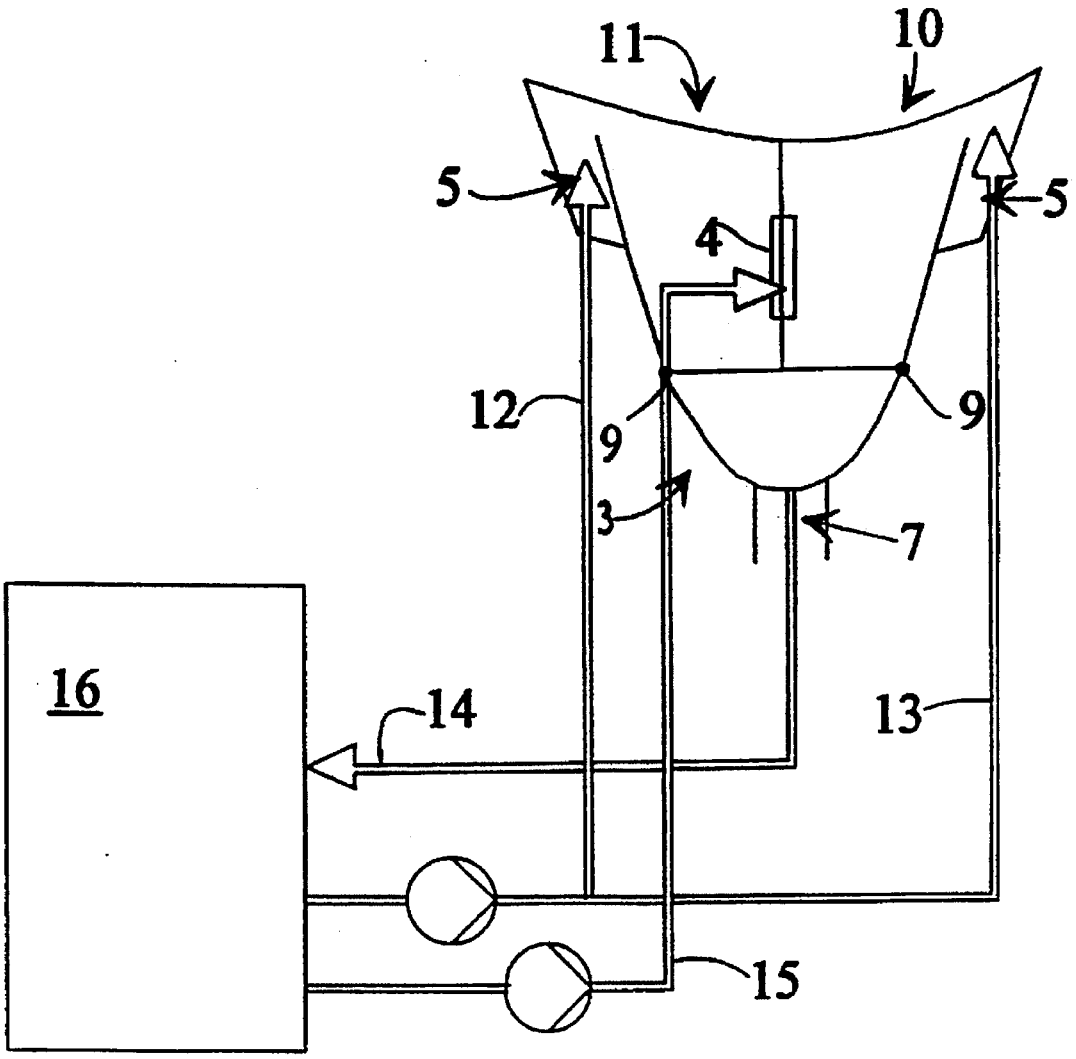
FIG. 3 is a schematic diagram illustrating the spray-coating apparatus of the present invention shown in FIG. 2 connected to a coating paste feed means.

Referring to FIG. 3, a flow control system is shown which comprises a first inlet nozzle 15 for feeding coating paste to the spraying nozzle 4 and second inlet nozzles 12 and 13 for feeding coating paste to the overflow trays 5. Excess coating mix is removed via an outlet nozzle 14 and dumped to a coating paste tank 16. This arrangement provides effective recycling of the coating paste.

Figure 4:
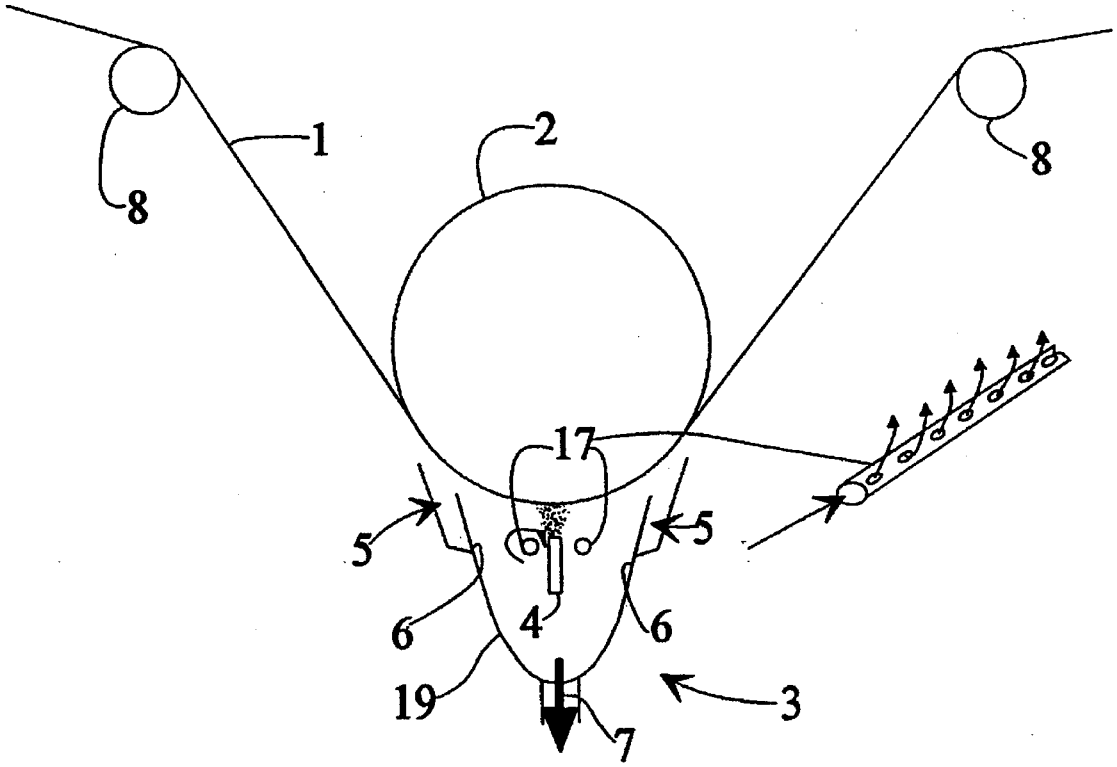
FIG. 4 is a side view of a third embodiment of the spray-coating apparatus according to the present invention.

As is evident from FIG. 4, the coater may also be provided with air discharge/suction pipes 17 positioned proximate the spraying nozzle 4 and mounted so that the pipes 17 are rotatable about their longitudinal axis as shown in FIG. 4. Proper control of these air flows provides improved absorption of the excess aerosol to the downward flows 18 shown in FIG. 1. Additionally, the interior pressure of the tray hood 19 can be adjusted with the air feed pipes 17 as required. The air discharged from the air pipes 17 is injected in a controlled manner via small holes in the pipes over the entire width of the web 1. The discharge direction of the air jets may be adjusted by rotating the air pipes 17. If the pressure of the compressed air introduced to the system causes the coating paste aerosol to escape from the coater, the air inlet to the system may be complemented with a pressure-reducing valve.

Figure 5:
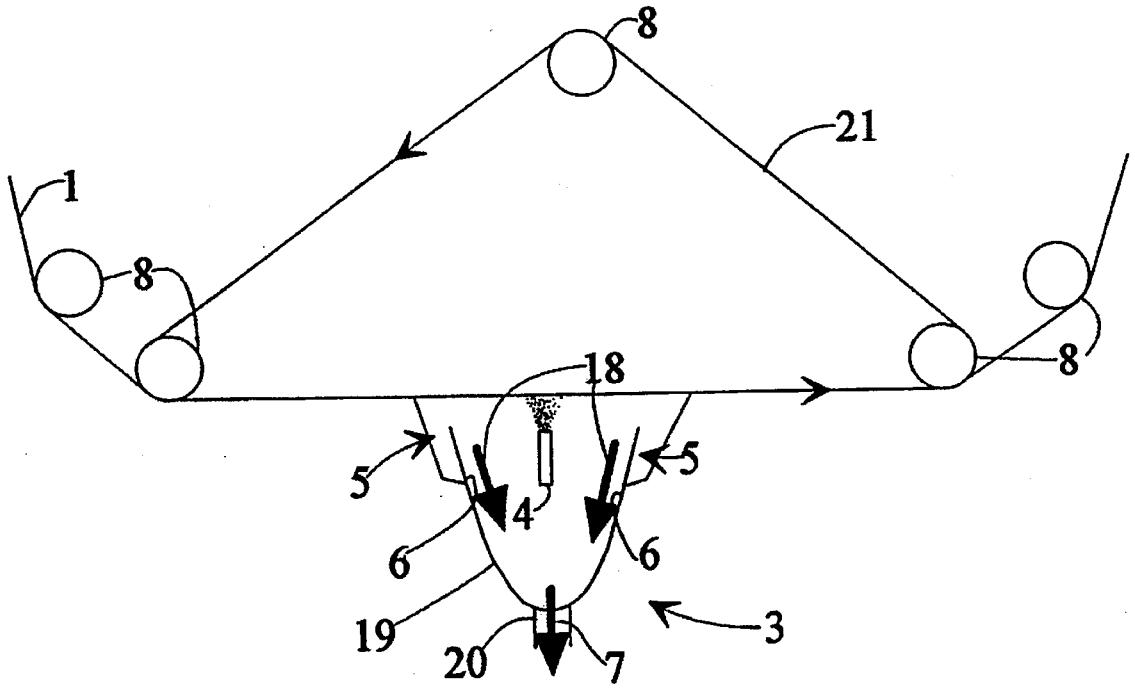
FIG. 5 is a side view of a fourth embodiment of the spray-coating apparatus according to the present invention.

As shown in FIG. 5, the spray-coating apparatus of the present invention may also be used with an endless web-supporting belt or wire 21 instead of the backing roll 2 shown in FIGS. 1 and 4.

Although an overflow tray 5 is shown as being on both of the side walls of the spray coater, alternatively only one overflow tray 5 may be used which is mounted on one of the two sides walls. Finally, overflow trays 5 may also be mounted to one or both of the end walls of the spray coater.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for applying a coating mix onto a moving paper or board web comprising:

spraying an aerosol of a coating mix onto a surface of a web within a chamber extending across a width of the web; and supplying a flowing stream of the coating mix to an inner wall of the chamber, the flowing stream of the coating mix flowing sufficiently proximate the surface of the web so as to substantially prevent the aerosol of the coating mix from escaping from the chamber between the stream of the coating mix and the web.

2. The method of claim 1, wherein a stream of coating mix is supplied to a plurality of the walls of the chamber.

3. The method of claim 1, further comprising supplying the coating mix to an overflow tray mounted to an outer wall of the chamber so that coating mix supplied to the overflow tray overflows to supply a flowing stream of the coating mix to the inner wall of the chamber.

4. The method of claim 1, further comprising supplying compressed air into the chamber.

5. An apparatus for applying a coating mix onto a moving paper or board web comprising:

a chamber positioned proximate a surface of a web to be coated with a coating mix, the chamber extending across a width of the web and having an opening directed toward the surface of the web to be coated with the coating mix;

at least one spray nozzle positioned within said chamber and directed at the surface of the web, the spray nozzle being capable of producing an aerosol spray of the coating mix; and a coating mix feed means for supplying a flowing stream of the coating mix to an inner wall of said chamber, the flowing stream of the coating mix flowing sufficiently proximate the surface of the web so as to substantially prevent the aerosol of the coating mix from escaping from said chamber between the stream of the coating mix and the web.

6. The apparatus of claim 5, wherein said coating mix feed means supplies a stream of coating mix to a plurality of the walls of said chamber.

7. The apparatus of claim 5, wherein said coating mix feed means further comprises an overflow tray mounted to an outer wall of said chamber so that coating mix that overflows said overflow tray supplies the flowing stream of the coating mix to the inner wall of said chamber.

8. The apparatus of claim 5, further comprising a means for supplying compressed air into said chamber.

9. The apparatus of claim 8, wherein the means for supplying compressed air into said chamber is proximate said spray nozzle.

10. The apparatus of claim 5, wherein said chamber is comprised of at least two sections that are hingedly connected to another of said sections so that said chamber is capable of being opened.

11. The method of claim 1, wherein the aerosol of the coating mix is sprayed using a plurality of spray nozzles arrayed to extend across a width of the web.

12. The apparatus of claim 5, wherein said at least one spray nozzle comprises a plurality of spray nozzles arrayed to extend across a width of the web.

* * * * *